US007524223B2

(12) United States Patent
Ochiai et al.

(10) Patent No.: US 7,524,223 B2
(45) Date of Patent: Apr. 28, 2009

(54) OUTBOARD MOTOR

(75) Inventors: Katsumi Ochiai, Shizuoka-ken (JP); Koshiro Inaba, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/586,784

(22) Filed: Oct. 25, 2006

(65) Prior Publication Data

US 2007/0093152 A1 Apr. 26, 2007

(30) Foreign Application Priority Data

Oct. 25, 2005 (JP) ..... 2005-309822

(51) Int. Cl.

| | |
|---|---|
| ***B63H 21/10*** | (2006.01) |
| ***B63H 21/38*** | (2006.01) |
| *B63B 35/73* | (2006.01) |
| *B63B 13/00* | (2006.01) |
| *F02B 61/04* | (2006.01) |
| *F02M 35/16* | (2006.01) |
| *F01P 3/20* | (2006.01) |
| *B63H 21/32* | (2006.01) |
| *F01N 7/00* | (2006.01) |
| *F01N 7/12* | (2006.01) |
| *F01N 1/08* | (2006.01) |

(52) U.S. Cl. ..... 440/88 R; 440/88 A; 440/88 N; 440/89 F; 440/89 J

(58) Field of Classification Search ..... 440/88 R, 440/88 A, 88 N, 89 F, 89 J
See application file for complete search history.

(56) References Cited

U.S. PATENT DOCUMENTS

| | | | | |
|---|---|---|---|---|
| 4,734,070 | A * | 3/1988 | Mondek | 440/88 R |
| 7,252,568 | B2 * | 8/2007 | Ito et al. | 440/77 |
| 2006/0258235 | A1 * | 11/2006 | Kimura et al. | 440/77 |
| 2007/0054569 | A1 * | 3/2007 | Murai et al. | 440/77 |

FOREIGN PATENT DOCUMENTS

| | | |
|---|---|---|
| JP | 2-147496 | 6/1990 |
| JP | 2002-114192 | 4/2002 |
| JP | 2004-239156 | 8/2004 |

* cited by examiner

*Primary Examiner*—Lars A Olson
*Assistant Examiner*—Daniel V Venne
(74) *Attorney, Agent, or Firm*—Knobbe, Martens, Olson & Bear, LLP

(57) ABSTRACT

An outboard motor is provided that is capable of reliably separating water and air sucked in from an intake port and efficiently draining the separated water. The motor can comprise a cowling, a right-side intake port, a left-side intake port, first and second water separating portions, a communication port, and an engine compartment. The right-side intake port can be formed in a right side surface portion of an upper portion of the cowling. The left-side intake port can be formed in a left side surface portion of the upper portion of the cowling. The first water separating portion can have an intake passage communicating between the right-side intake port and the left-side intake port. The second water separating portion can communicate with the first water separating portion through the communication port, and the second water separating portion can communicate with the engine compartment.

22 Claims, 11 Drawing Sheets

OUTBOARD MOTOR

CROSS-REFERENCE TO RELATED APPLICATIONS

The present application is based on and claims priority under 35 U.S.C. § 119 to Japanese Patent Application No. 2005-309822, filed on Oct. 25, 2005, the entire contents of which is expressly incorporated by reference herein.

BACKGROUND

1. Field of the Inventions

The present inventions relate to an outboard motor having a water separating portion for preventing the ingress of water from the intake opening of an intake duct.

2. Description of the Related Art

In the related art, there are inventions relating to an outboard motor, boat, or cowling that is equipped with a water separating portion to ensure that air sucked in from the outside into an internal combustion engine can be purified before reaching the opening of an intake duct and sucked in from the intake duct. In such an outboard motor, boat, or cowling, the water separating portion separates and removes water from the outside air as the air passes through the water separating portion, and thereafter air is passed into the internal combustion engine for combustion to thereby drive the internal combustion engine. Examples of such an outboard motor, boat, or cowling include those described in JP-A-2004-239156, JP-A-2002-114192, and JP-A-Hei 2-147496.

First, JP-A-2004-239156 describes as follows: "In an outboard motor, the direction of air flowing in from an outside-air intake port formed in a side air duct is changed to the transverse direction as the air passes through an air passage that is bent at some point. Thus, the air having moisture mixed therein is removed of moisture, and further, the direction of air flowing into a downstream-side intake chamber via a communication port is changed to the vertical direction to thereby separate moisture again, and the air from which moisture has been separated in two steps as described above is mixed with fuel."

Further, JP-A-2002-114192 describes as follows: "In a boat, an intake system having an intake port is provided in front of an intake opening of an intake duct, and a water-repellent filter allowing passage of air but not allowing passage of water is arranged within the intake system, so that even when water ingresses from the intake port of the intake system, the ingress of water into the intake opening of the intake duct is prevented."

Further, JP-A-Hei 2-147496 describes as follows: "A cowling of an outboard motor includes an air intake recess that is open laterally with respect to the propulsion direction, an intake duct portion provided upright with respect to the bottom surface of the air intake recess and having an intake port formed at its top portion, and a duct cover portion provided above the intake duct portion so as to surround the intake port of the intake duct portion, thereby making it possible to prevent the ingress of water into the cowling from the rear of the cowling or to prevent the ingress of water from the air intake recess in the tilt-up state."

SUMMARY

However, although the invention described in JP-A-2004-239156 is designed to ensure that water that ingresses through the outside-air intake port can be removed through the combination of the volume of the intake chamber and the height of the communication port, if a large amount of water ingresses from the outside-air intake port, there is a possibility that the water may not be completely drained and sucked into the intake opening of the intake duct as it is. Further, although the succeeding water removal structure due to a silencer and an intake passage for a funnel is that of a funnel structure, it is unclear how the water drainage structure is constructed; if the amount of ingress water is large, there is a possibility that water may accumulate within the outboard motor or may ingress into the intake opening of the intake duct.

Further, in the invention described in JP-A-2002-114192, by passage through the filter having water repellency, water is blocked by the filter while allowing passage of air. However, if the amount of water is large, there is a possibility that water may accumulate within the space to cause clogging of the filter, resulting in insufficient separation between water and air.

Further, in the invention described in JP-A-Hei 2-147496, the intake duct projects from the bottom wall of the intake port communication passage. Thus, if a large amount of water flows into the intake port communication passage, the water will vigorously collide against the side portions of the intake duct portion, which may result in the ingress of water from the opening of the intake duct portion into the intake duct within the cowling. Further, since the intake port communication passage is linear, a sufficient volume cannot be secured for the air intake recess, so there is a possibility that water may fill the entire air intake recess, causing ingress of water from the intake duct into the cowling.

In view of the above, an aspect of one embodiment is to achieve an improvement in the drainage property of an outboard motor having an intake port formed in each left and right side surfaces of a cowling body, thereby providing an outboard motor capable of preventing the ingress of water into an intake duct.

Another aspect of an embodiment is to provide an outboard motor having improved an efficiency with which a large amount of water and air are separated from each other when a large amount of water is contained in the air sucked in from an intake port. This aspect can make it possible to inhibit the ingress of water into an engine compartment.

In order to achieve the at least some of the above-mentioned objects, the an outboard motor is provide that can comprise an intake port formed in an upper portion of a cowling and a water separating portion communicating with the intake port. The water separating portion and an engine compartment can be in communication with each other by an intake duct. The intake port can include a right-side intake port formed in a right side surface portion of the upper portion of the cowling and a left-side intake port formed in a left side surface portion of the upper portion of the cowling. The water separating portion can include first and second water separating portions. The first water separating portion can have an intake port communication passage that can communicate between the right-side intake port and the left-side intake port. The second water separating portion can be in communication with the first water separating portion via a communication port. The second water separating portion can communicate with the engine compartment.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

FIGS. 1-11 illustrate various embodiments of an engine and assembly having an intake port formed in an upper portion of a cowling, and a water separating portion communicating with the intake port. The embodiments disclosed herein are described in the context of a marine propulsion system because these embodiments have particular utility in this context. However, the embodiments and inventions herein can also be applied to other marine vessels, boats, such as small jet boats, as well as other land and marine vehicles. It is to be understood that the embodiments disclosed herein are exemplary but non-limiting embodiments, and thus, the inventions disclosed herein are not limited to the disclosed exemplary embodiments.

Figure 1:
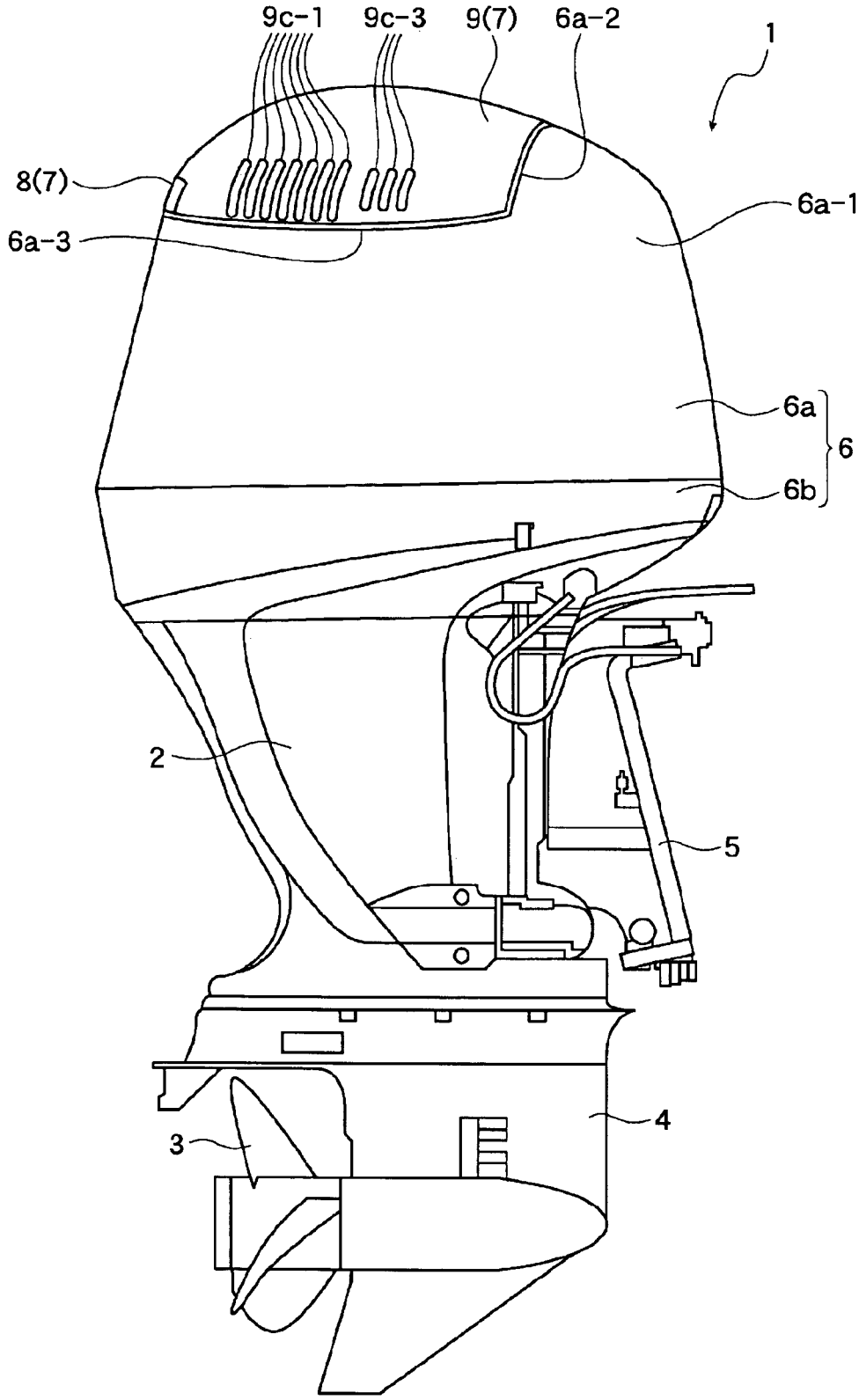
FIG. 1 is a side view showing an outboard motor according to a first embodiment.

With reference to FIGS. 1 to 7, a first embodiment of an outboard motor will now be described. As shown in FIG. 1, the construction of an outboard motor 1 can comprise a drive shaft housing 2, a propeller 3, a gear casing 4, a mounting bracket 5, a cowling 6, and an engine compartment 11 (see FIG. 3). The gear casing 4 can incorporate a gear mechanism for rotationally driving the propeller 3. The gear casing 4 can be coupled to the lower portion of the drive shaft housing 2. The cowling 6 can at least partially surround the engine compartment 11 (see FIG. 3) and can be connected to the upper portion of the drive shaft housing 2. The mounting bracket 5 can be provided on the front side of the drive shaft housing 2. The outboard motor 1 can also be mounted to a hull of a boat (not shown) by means of the mounting bracket 5. The cowling 6 can include a top cowl body 6*a* as part of a "cowling body," and a bottom cowl body 6*b* as a part of the "cowling body." The mating portion between the top cowl body 6*a* and the bottom cowl body 6*b* can include a seal, thereby allowing the top cowl body 6*a* to be detachably mounted to the bottom cowl body 6*b* while mitigating against the ingress of water, particulate, and the like.

Figure 2:
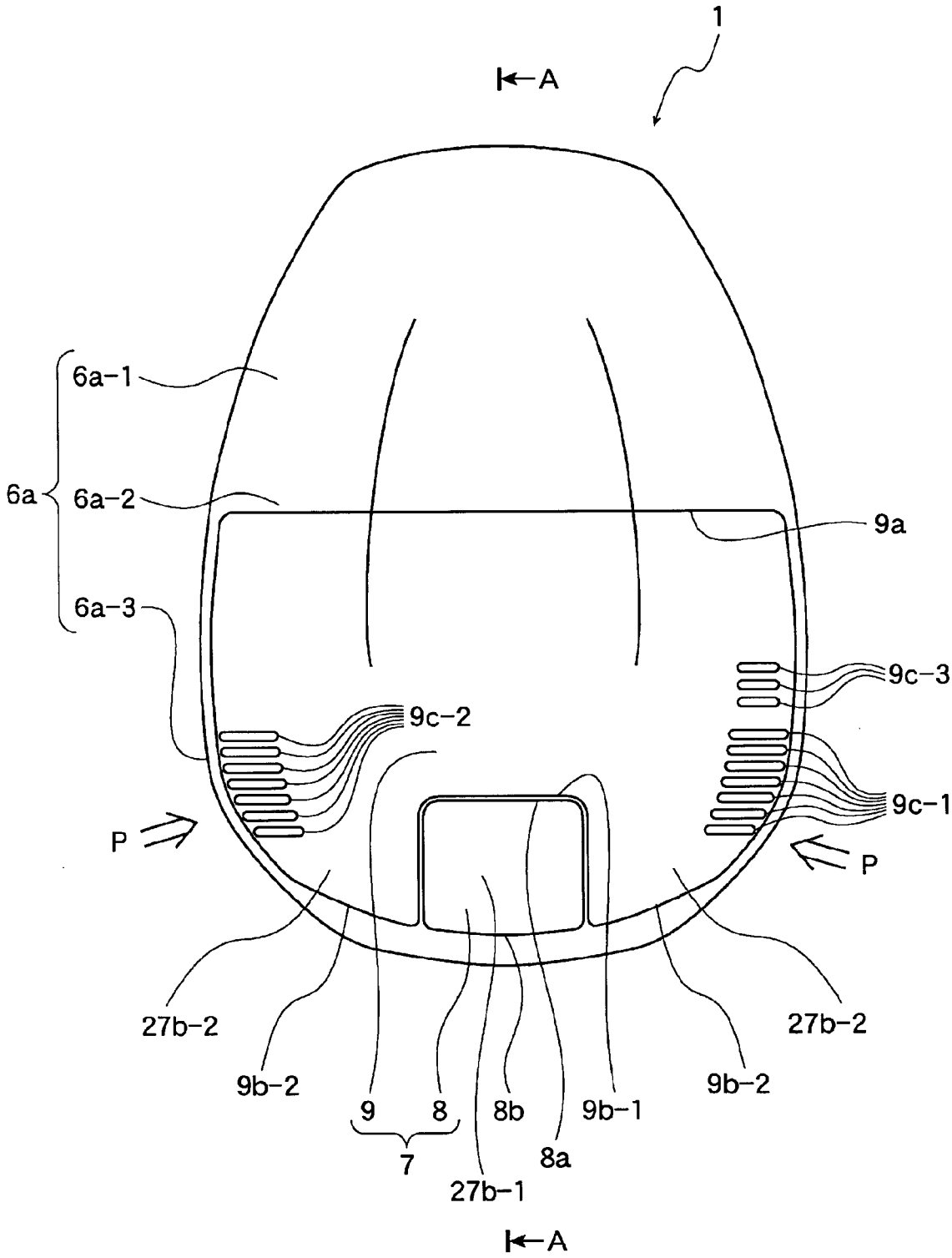
FIG. 2 is a plan view of the outboard motor of FIG. 1.

Further, as shown in FIGS. 1 and 2, on the upper side of the cowling 6 of the outboard motor 1, the top cowl body 6*a* can have a front-side upper portion 6*a*-1 as a part of an "upper portion," a center-side step side surface portion 6*a*-2 as a part of the "upper portion," and a rear-side step floor surface portion 6*a*-3 as a part of the "upper portion." Further, the rear-side step floor surface portion 6*a*-3 can be recessed with respect to the center-side step side surface portion 6*a*-2. Further, a hinge 14 can be connected to an upper-side portion of the center-side step side surface portion 6*a*-2 and a cover 7. The cover 7 can be pivotable about the hinge 14 with respect to the center-side step side surface portion 6*a*-2. Thus, the proximal end portion of the cover 7 can be attached to the hinge 14 so as to freely open and close with respect to the top cowl 6*a* (see FIGS. 3 and 4).

Figure 3:
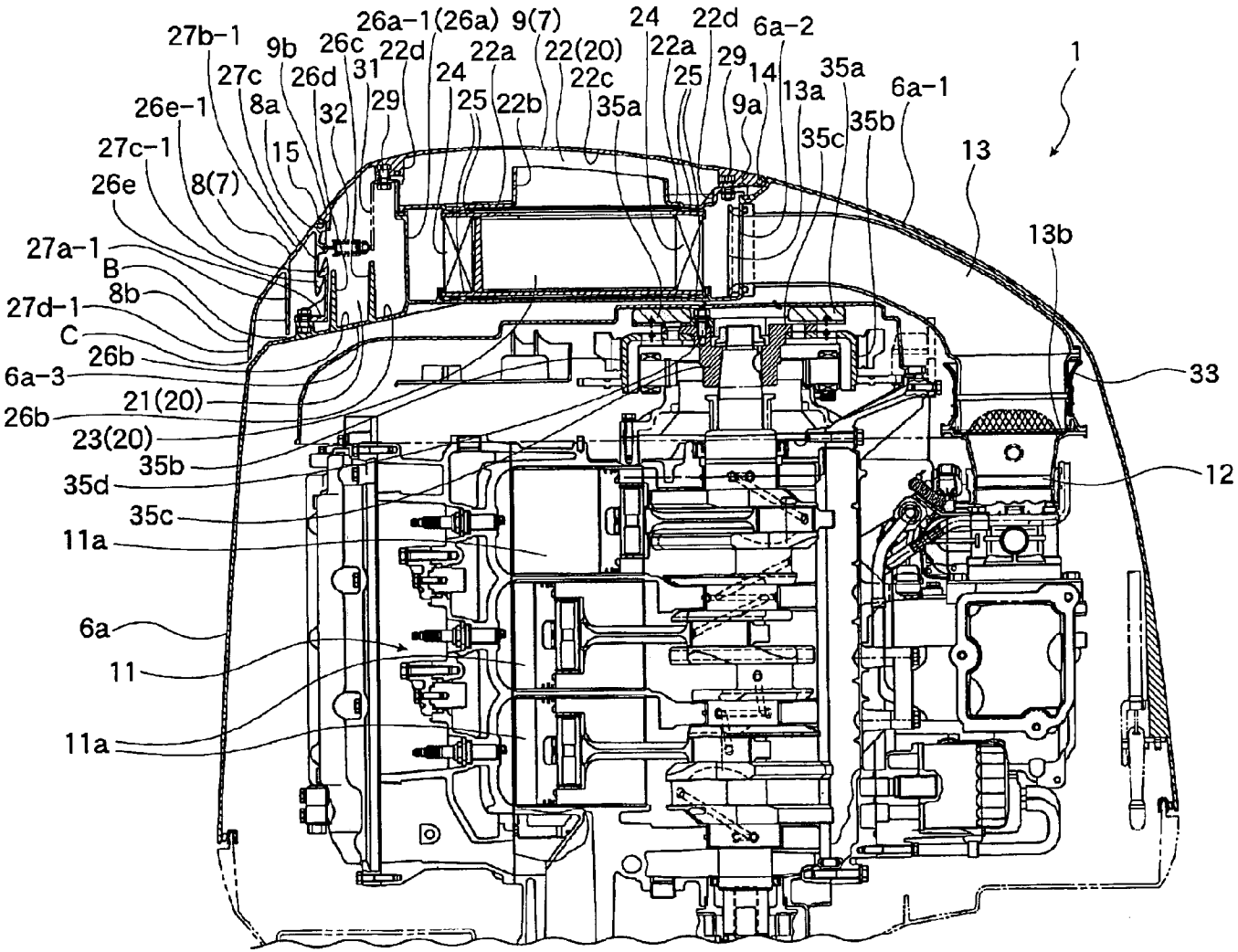
FIG. 3 is a side sectional view of the outboard motor taken along the line A-A of FIG. 2.
Figure 4:
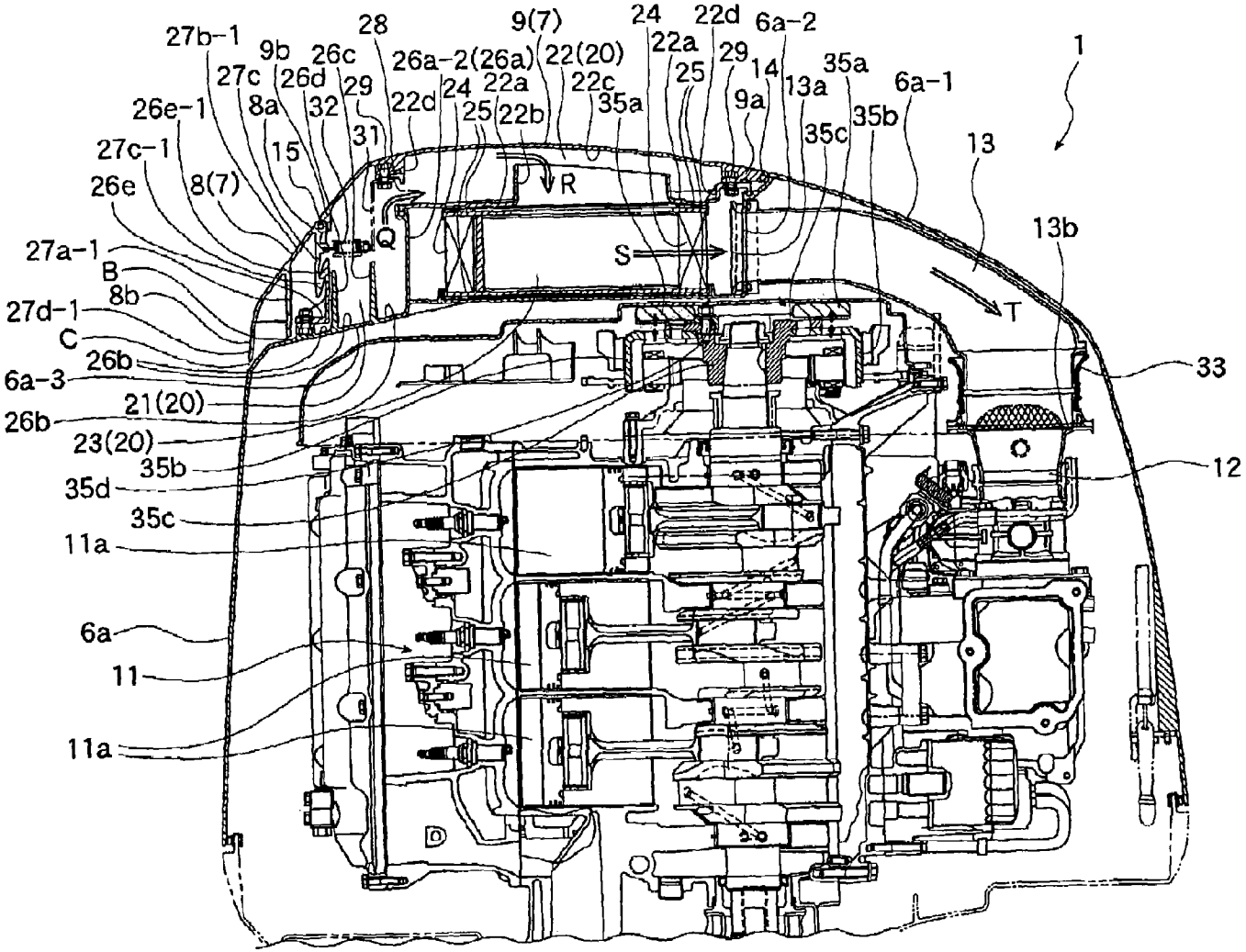
FIG. 4 is a side end view of the outboard motor taken along the line B-B of FIG. 5(*a*), showing a state in which a side wall portion of a front wall is removed.

As shown in the exemplary configuration of FIG. 2, the cover 7 can comprise a cover body 9 and an open/close knob 8 (which can also be referred to as a handle) that can be mounted to the cover body 9. For example, FIGS. 2 to 4 illustrate that a proximal end portion 9*a* of the cover body 9 can be attached to the center-side step side surface portion 6*a*-2 so as to be pivotable about the hinge 14. Further, a distal end portion 9*b*-2 can be formed on the distal end side of the cover body 9. The distal end portion 9*b*-2 can have an arcuate shape in plan view and a recessed portion 9*b*-1 formed substantially at the center of the distal end portion 9*b*-2. A proximal end portion 8*a* of the open/close knob 8 can be pivotably attached to the recessed portion 9*b*-1 by means of a hinge 15. As such, the knob 8 is movable. Further, with the cover 7 closed, a distal end portion 8*b* of the open/close knob 8 can be substantially flush with the top cowl body 6*a*.

As shown in FIG. 2, a right-side intake port 9*c*-1 can be formed in the cover body 9 at a location corresponding to the right side surface of the cowling 6. Further, a left-side intake port 9*c*-2 can also be formed in the cover body 9 at a location corresponding to the left surface side of the cowling 6. Furthermore, as shown in FIG. 2, a ventilation exhaust port 9*c*-3 can formed in the cover body 9 on the side in front of the right-side intake port 9*c*-1 for exhausting air that passes through a ventilation duct (not shown).

With reference to FIG. 3, the engine compartment 11 can be at least partially surrounded by the top cowl body 6*a*. A throttle body 12 (which can function as a "throttle portion") can be provided on a side in front of the engine compartment 11. Further, an intake duct 13 can be mounted inside the front-side upper portion 6*a*-1 of the top cowl body 6*a* and above the throttle body 12. The intake duct 13 can be mounted such that an intake opening 13*a* formed at one end of the intake duct 13 can open toward the center-side step side surface portion 6*a*-2; further the intake duct 13 can be mounted such that a connecting portion 13*b* formed at another end of the intake duct 13 can be in fitted engagement with the throttle body 12.

Figure 5:
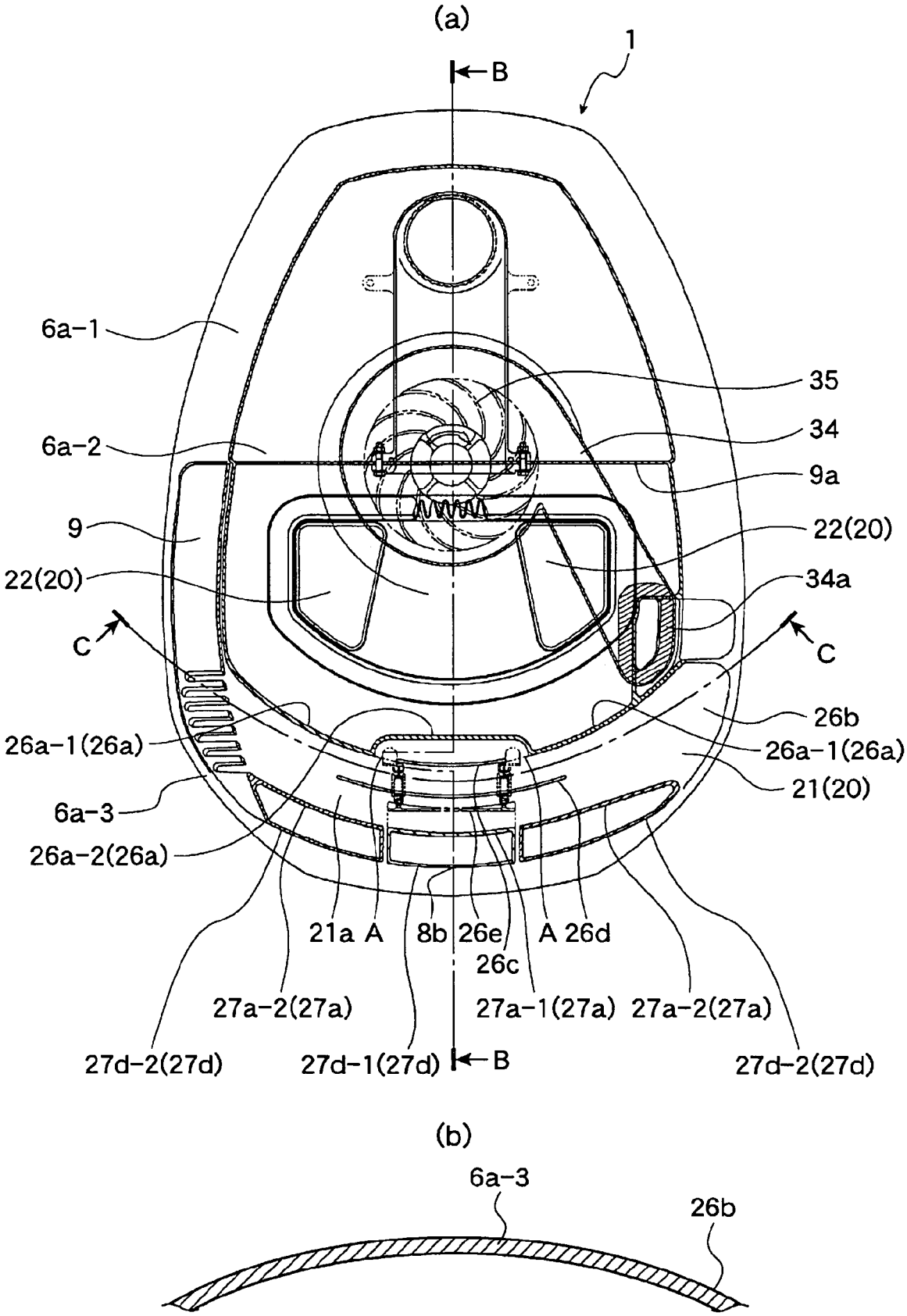
FIGS. 5(*a*) and 5(*b*) show the outboard motor of FIG. 1, in which FIG. 5(*a*) is a plan sectional view of the outboard motor, and FIG. 5(*b*) is a schematic end view of the outboard motor taken along the line C-C of FIG. 5(*a*).

As shown in FIGS. 3 to 5(*a*), the intake ports 9*c*-1, 9*c*-2 and the intake opening 13*a* can be in fluid communication with each other through an intake passage 20. The intake passage 20 can comprise a first water separating portion 21, a second water separating portion 22, and a third water separating portion 23, which can serve to separate water so that water is not sucked into the engine compartment 11.

As shown in FIGS. 3 to 5(*a*), the first water separating portion 21 can have an intake passage 21*a* as part of an "intake port communication passage." The intake passage 21*a* can be arcuate and can be formed on the rear-side step floor surface portion 6*a*-3 of the cowling 6. In this regard, the intake passage 21*a* can be configured such that with the cover 7 closed, the intake passage 21*a* can be surrounded by a front wall 26*a* and a bottom wall 26*b* (which can be formed in the rear-side step floor surface portion 6*a*-3), a cover body rear wall 27*a*-2 and a cover body ceiling wall 27*b*-2 (which can be formed in the cover body 9), and an open/close knob rear wall 27*a*-1 and an open/close knob ceiling wall 27*b*-1 (which can be formed in the open/close knob 8).

FIGS. 2 and 5(*a*) illustrate that according to an embodiment, the intake passage 21*a* of the first water separating portion 21 can also serve as a passage communicating between the right-side intake port 9*c*-1 and the left-side intake port 9*c*-2. In such an embodiment, the intake passage 21*a* can be formed so as to be curved annularly in a convex shape toward the rear of the outboard motor 1.

As shown in FIGS. 3 and 4, in the rear-side step floor surface portion 6*a*-3 of the cowling 6, the front wall 26*a*, a passage front wall-side guide wall 26*c* (a "guide wall"), a passage substantially-center guide wall 26*d* (another "guide wall"), and a locked wall 26*e* can be formed from the front side toward the rear side of the cowling 6 so as to extend upwardly from the bottom wall 26*b*. In a preferred implementation, these elements can be formed in the stated order from the front side toward the rear side of the cowling 6.

As shown in FIG. 5(*a*), the front wall 26*a* can be formed in an annular shape on the rear side of the cowling 6. The front wall 26*a* can include a central wall portion 26*a*-2 and two side wall portions 26*a*-1. The central wall portion 26*a*-2 can be formed such that the front wall 26*a* can protrude toward the front of the outboard motor 1 at substantially the center thereof. Additionally, the two side wall portions 26*a*-1 can be formed so as to extend continuously in an annular shape on both sides of the central wall portion 26*a*-2. Further, a communication port 28 can also be formed between the portion above the central wall portion 26*a*-2 and the cover body 9. Therefore, with the cover 7 closed with respect to the cowling 6, as shown in FIG. 4, the communication port 28 can provide fluid communication between the first water separating portion 21 and the second water separating portion 22.

The communication port 28 can preferably be open at a position higher than the bottom wall 26*b* of the intake passage 21*a*. As shown in FIG. 3, although no opening may be provided between the side wall portion 26*a*-1 and the cover body 9, as shown in FIG. 4, the communication port 28 can be open between the central wall portion 26*a*-2 and the cover body 9.

As shown in FIG. 5(*b*), the bottom wall 26*b* is formed as an inclined surface that is tilted downward toward the right-side intake port 9*c*-1 and the left-side intake port 9*c*-2 with substantially the central portion thereof being at the top. That is, the bottom wall 26*b* is formed so as to be tapered toward the intake ports 9*c*-1, 9*c*-2 from substantially the central portion thereof at the center.

The passage front wall-side guide wall 26*c* can be provided on an imaginary line connecting between the two side wall portions 26*a*-1 constituting the front wall 26*a*. The passage front wall-side guide wall 26*c* can be provided in rear of the central wall portion 26*a*-2. Further, the passage front wall-side guide wall 26*c* can be provided so as to leave a gap "A" (shown in FIG. 5*a*) of a predetermined distance between the passage front wall-side guide wall 26*c* and each of the two side wall portions 26*a*-1. In such an embodiment, water that has ingressed into the second water separating portion 22 can therefore be allowed to pass through the gap A to flow into the first water separating portion 21.

The passage substantially-center guide wall 26*d* can be formed in parallel to the passage front wall-side guide wall 26*c*. In some embodiments, the passage substantially-center guide wall 26*d* can be located closer toward the rear of the cowling 6 than the passage front wall-side guide wall 26*c*. The passage substantially-center guide wall 26*d* can serve to guide the water that has ingressed through one of the intake ports 9*c*-1, 9*c*-2 to the other of the intake ports 9*c*-1, 9*c*-2.

In accordance with an aspect of some embodiments, the passage front wall-side guide wall 26*c* and the passage substantially-center guide wall 26*d* can be provided in order to cause water to flow along the intake passage 21*a*.

With reference to FIGS. 3 to 4, the locked wall 26*e* can have an engaged portion 26*e*-1 formed at its distal end. The engaged portion 26*e*-1 can be brought into engagement with an engaging portion 27*c*-1 formed in a locking wall 27*c*. The engaging portion 27*c*-1 can be formed in the open/close knob 8, which is described below with reference to FIG. 6.

As shown in FIGS. 3 and 4, the open/close knob 8 can comprise the locking wall 27*c*, the open/close knob rear wall 27*a*-1, and an open/close knob rear end portion 27*d*-1. In some embodiments, these elements can be formed in an annular shape and/or in the stated order from the front toward the rear of the cowling 6 so as to extend downward from the open/close knob ceiling wall 27*b*-1.

Further, the cover body 9 can also have the cover body rear wall 27*a*-2 and a cover body rear-end wall 27*d*-2. In some embodiments, the cover body rear wall 27*a*-2 and the cover body rear-end wall 27*d*-2 can be formed in an annular shape and/or in the stated order from the front toward the rear of the cowling 6 so as to extend downward from the cover body ceiling wall 27*b*-2.

In accordance with an embodiment, the open/close knob rear wall 27*a*-1 (which can be formed in the open/close knob 8) and the cover body rear wall 27*a*-2 (which can be formed in the cover body 9) can become substantially flush with respect to each other when the cover 7 is closed with respect to the cowling 6. That is, the open/close knob rear wall 27*a*-1 and the cover body rear wall 27*a*-2 can be sized and formed on substantially the same arcuate trajectory. Further, as shown in FIGS. 3 and 4, a gap "B" can be formed between the lower ends of the rear walls 27*a*-1, 27*a*-2 and the rear-side step floor surface portion 6*a*-3. Thus, as shown in FIGS. 3 to 5(*a*), water that ingresses into the first water separating portion 21 can be discharged to the outside if such water passes along the portion of the bottom wall 26*b* where the passage substantially-center guide wall 26*d* is not provided.

The locking wall 27*c* can be formed on the most proximal end portion 8*a* side of the open/close knob 8. Further, the locking wall 27*c* can have formed therein the engaging portion 27*c*-1 that can be configured to engage with the engaged portion 26*e*-1 of the locked wall 26*e* described above. Further, a spring holding member 31 can be mounted to the back surface of the cover body 9. The spring holding member 31 and the locking wall 27*c* can be connected to each other by a spring 32. The spring 32 can thus be utilized to urge the locking wall 27*c* toward the cover body 9.

Accordingly, upon opening the open/close knob 8, the engagement between the engaged portion 26*e*-1 of the locked wall 26*e* and the engaging portion 27*c*-1 of the locking wall 27*c* can be released, causing the entire cover 7 to open. Conversely, when the cover body 9 moves toward the cowling 6, the engaging portion 27*c*-1 formed in the locking wall 27*c* of the open/close knob 8 can be urged by the spring 32 toward the cover body 9 into engagement with the engaged portion 26*e*-1, thus causing the cover 7 to close.

The open/close knob rear-end wall 27*d*-1 can be formed at the distal end portion 8*b* of the open/close knob 8. Additionally, the cover body rear-end wall 27*d*-2 can be formed at the distal end portion 9*b*-2 of the cover body 9. The open/close knob rear-end wall 27*d*-1 and the cover body rear-end wall 27*d*-2 can be formed so as to be located closer to the rear of the cowling 6 than the rear walls 27*a*-1, 27*a*-2. Furthermore, the open/close knob rear-end wall 27*d*-1 and the cover body rear-end wall 27*d*-2 can be formed so as to become flush with the side surface of the cowling 6. A gap "C" can be formed between the lower end portions of the rear-end walls 27*d*-1, 27*d*-2 and the rear-side step floor surface portion 6*a*-3 of the cowling 6 to thereby allow water that has ingressed into the first water separating portion 21 to be discharged to the outside.

The second water separating portion 22 can be sized and configured to be in fluid communication with the first water separating portion 21. The second water separating portion 22 can be disposed in front of the intake passage 21*a* (which can be formed in the first water separating portion 21). The third water separating portion 23 can be sized and configured to be in fluid communication with the second water separating portion 22, and can be disposed below the second water separating portion 22. A partition wall 22*a* can also be provided, which can be the bottom wall of the second water separating portion 22. The partition wall 22*a* can be disposed between the second water separating portion 22 and the third water separating portion 23, and can be attached onto the back surface of the cover body 9 by means of a bolt 29. An upwardly extending hollow annular member 22*b* can be formed in the partition wall 22*a*. Thus, air in the second water separating portion 22 can be sucked into the third water separating portion 23 from the upper-end opening of the hollow annular member 22*b*.

Further, as shown in FIGS. 3 and 4, the partition wall 22*a* of the second water separating portion 22 can be formed so as to be tilted downward toward the intake passage 21*a*. Water can be separated as it passes through the second water separating portion 22. The separated water can pass through the gap "A" (see FIGS. 5(*a*) and 5(*b*)) by way of the partition wall 22*a* to flow into the intake passage 21*a*. Finally, as described above, the separated water can then pass through the gap "B" and the gap "C" to be discharged to the outside.

The third water separating portion 23 can comprise a hollow cylinder-shaped water-repellent filter 24 having water repellency. The intake opening 13*a* of the intake duct 13 described above can be arranged on the side in front of the water-repellent filter 24. A seal member 25 can be provided to each of the upper and lower surfaces of the water-repellent filter 24, whereby, with the cover 7 closed with respect to the cowling 6, a reliable seal can be achieved between the lower end of the partition wall 22*a* and the upper end of the water-repellent filter 24, and between the rear-side step floor surface portion 6*a*-3 and the water-repellent filter 24. Accordingly, the ingress of water from the second water separating portion 22 into the third water separating portion 23 can be prevented both in the upper and lower portions of the water-repellent filter 24.

Further, the cover 7 can be attached to the cowling 6 so as to freely open and close. Accordingly, the intake passage 21*a* can be formed with the cover 7 closed, and the water-repellent filter 24 can be extracted with the cover 7 open.

In the intake duct 13, an intake pressure sensor (not shown) can be arranged in proximity to the intake opening 13*a*. Pressure loss due to the water-repellent filter 24 can be detected on the basis of the output value of the intake pressure sensor, and the output value can be detected by an engine control unit (not shown) serving as "control means" constituting a part of "replacement timing transmitting means." When a preset threshold is exceeded, a lamp (not shown, but which can be provided on the boat operating room side or on the outboard motor 1 side and can serve as "lighting means" constituting a part of "replacement timing transmitting means") can be lit to urge the boat operator to replace the water-repellent filter 24. The boat operator can thus readily confirm whether or not the intake passage 20 has been clogged, thereby making it possible to secure the output of the engine compartment 11 by replacing the water-repellent filter 24.

Further, the portion of the intake opening 13*a* formed at one end of the intake duct 13 can be detachably attached to the center-side step side surface portion 6*a*-2 of the cowling 6. The intake duct 13 can be arranged so that the intake opening 13*a* side is in the horizontal direction. Arranging the intake duct 13 in the horizontal direction in this way can also prevent water contained in the air from flowing into the throttle body 12. The other end of the intake duct 13 can be attached to the throttle body 12, and can be in fitting engagement with an elastic connecting member 33, which can be open in a bell shape. The connecting member 33 can be made of various types of suitable materials, including but not limited to rubber or the like.

Further, as shown in FIGS. 5(*a*) and 5(*b*), the outboard motor 1 can also be equipped with a ventilation fan 35 arranged substantially at the center of the cowling 6. Air can be guided by the ventilation fan 35 and discharged to the outside, for example, through the ventilation exhaust port 9*c*-3 shown in FIG. 2 via a ventilation duct 34.

The ventilation fan 35 can be a separate component that can be mounted by use of a drawing jig mounting screw, which can be used when disassembling the conventional flywheel magnet. That is, a fin holding member 35*c* provided with a fin 35*a* can be fixed with respect to a flywheel magnet outer frame member 35*b* by means of a rivet 35*d*. This construction can make it possible to form the fin 35*a* as a separate component. Further, a reduction in weight can be achieved if the fin 35*a* is formed from a lightweight material such as resin or the like. Thus, the costs of the flywheel magnet can be reduced.

According to an aspect of embodiments, the ingress of water into the cowling 6 can be mitigated. Further, any water that ingresses into the cowling 6 can be drained from the outboard motor 1 even when the rear-side step floor surface portion 6*a*-3 and the center-side step side surface portion 6*a*-2 of the cowling 6 are closed with the cover 7. These features of embodiments will now be described in additional detail.

In operation, air entering from the intake opening 13*a* can pass through the intake duct 13 and flow into the throttle body 12. After the air and fuel are mixed together in the throttle body 12, the air/fuel mixture can flow into a combustion chamber 11*a* of the engine compartment 11 via an air/fuel mixture passage tube (not shown) for combustion (see FIGS. 3, 4). In this regard, the use of the first water separating portion 21, the second water separating portion 22, and the water separating portion 23 in front of the intake opening 13*a* can provide many beneficial effects, as described below.

First, when a boat (not shown) having the outboard motor 1 makes a turn or the like on the water, a large amount of water can ingress into the right-side intake port 9*c*-1 or the left-side intake port 9*c*-2 (see FIGS. 2, 5(*a*)). However, water that ingresses through the left-side intake port 9*c*-2 can pass through the top of the intake passage 21*a* and be similarly drained from the right-side intake port 9*c*-1.

Further, for example, if water ingresses through the right-side intake port 9*c*-1 and reaches the top of the intake passage 21*a*, the water can then flow to the left-side intake port 9*c*-2 and be drained to the outside by the bottom wall 26*b*, which can be tilted downward toward the left-side intake port 9*c*-2 (see FIG. 5(*a*)).

Further, water flowing between the rear wall 27*a* and the front wall 26*a* can pass through the gaps "B" and "C," shown in FIGS. 3 and 4, and be discharged to the outside.

At this time, the ingress of water through the portion between the rear wall 27*a* and the passage substantially-center guide wall 26*d* into the second water separating portion 22 can be prevented by the passage substantially-center guide wall 26*d*. Further, the ingress of water through the portion between the passage substantially-center guide wall 26*d* and the passage front wall-side guide wall 26*c* into the second water separating portion 22 can be prevented by the passage front wall-side guide wall 26*c*.

Next, if water that has ingressed into the first water separating portion 21 and passes through the communication port 28 together with air and ingresses into the second water separating portion 22, the majority of the water can be blasted onto a ceiling surface 22*c* or the outer side surface of the hollow annular member 22*b* during passage through the second water separating portion 22, and thus flow along an inner side surface 22*d* or the outer side surface of the hollow annular member 22*b* onto the partition wall 22*a*. Therefore, embodiments provide that mostly air passes through the hollow annular member 22*b*.

The water having flown onto the partition wall 22*a*, as described above, can move on the partition wall 22*a* to be returned to the intake passage 21*a*. When this occurs, the water can pass through the gap "B" and the gap "C" to be discharged to the outside.

As described above, water that has ingressed into the first water separating portion 21 can be removed by means of the intake passage 21*a* and gaps "B" and "C" of the first water separating portion 21 and the ceiling surface 22*c* and partition wall 22*a* of the second water separating portion 22. Although a large amount of water may rarely pass through the hollow annular member 22*b*, moisture, such as water vapor in the flowing air, may pass through the hollow annular member 22*b*. However, the ingress of such moisture can be prevented as the flowing air passes through the water-repellent filter 24 provided within the third water separating portion 23.

Due to the above-described arrangement, air that passes through the water-repellent filter 24 can be processed so as to contain almost no moisture. Such air can then be sucked into the intake opening 13*a* of the intake duct 13 and then introduced into the throttle body 12. An exemplary flow pattern of the air is: the air flows in from the intake ports 9*c*-1, 9*c*-2, passes through the intake passage 21*a* as indicated by the arrow P in FIG. 2, passes through the communication port 28 as indicated by the arrow Q in FIG. 4, passes through the hollow annular member 22*b* as indicated by the arrow R, passes through the water-repellent filter 24 as indicated by the arrow S, and finally passes through the intake duct 13 as indicated by the arrow T.

Figure 6:
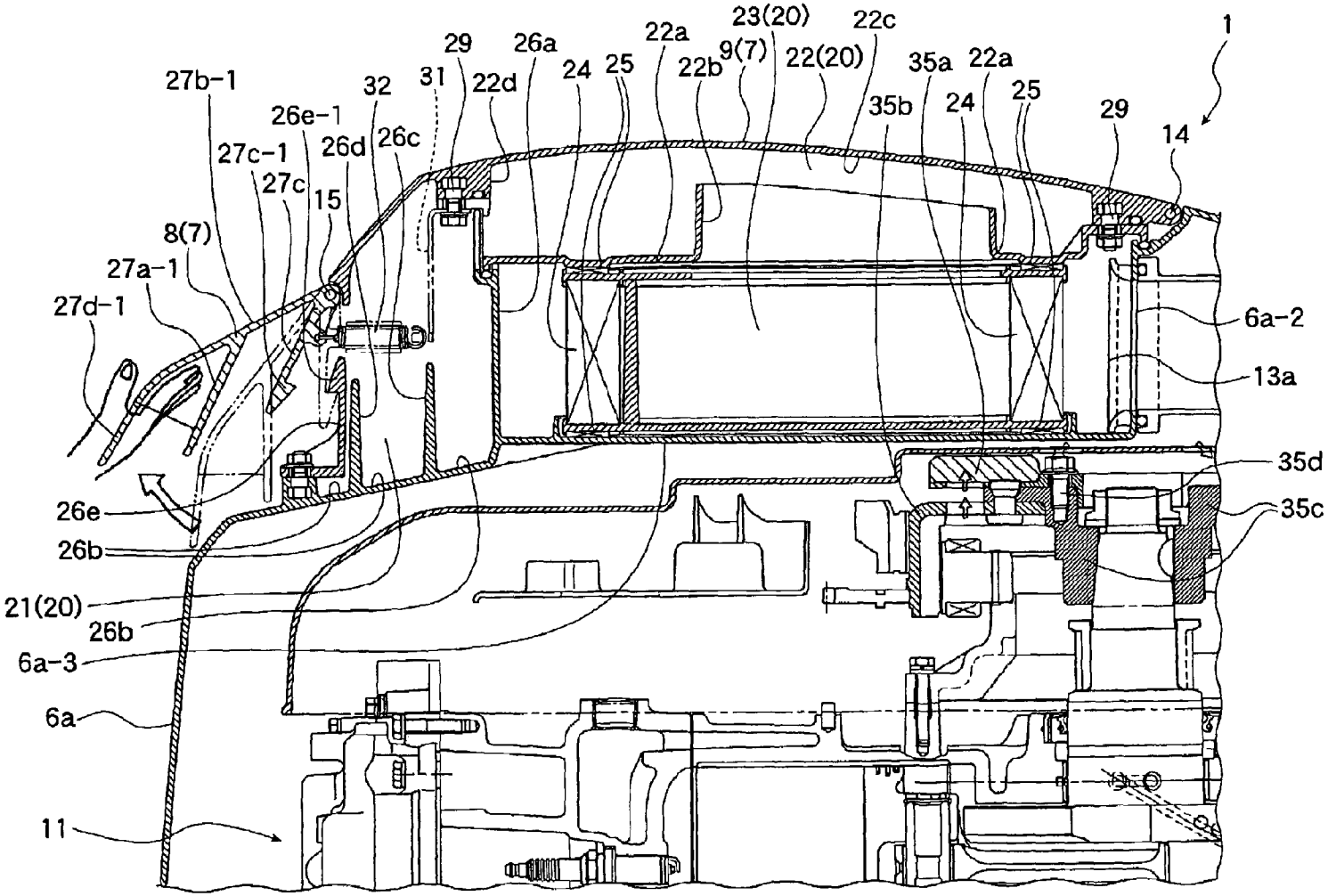
FIG. 6 is a side sectional view of the outboard motor of FIG. 1 in a state in which an open/close knob is open.

Turning now to the operation of opening/closing the cover 7 with respect to the cowling 6, FIG. 6 illustrates a side sectional view of the outboard motor of FIG. 1 in a state in which the open/close knob 8 is open.

Figure 7:
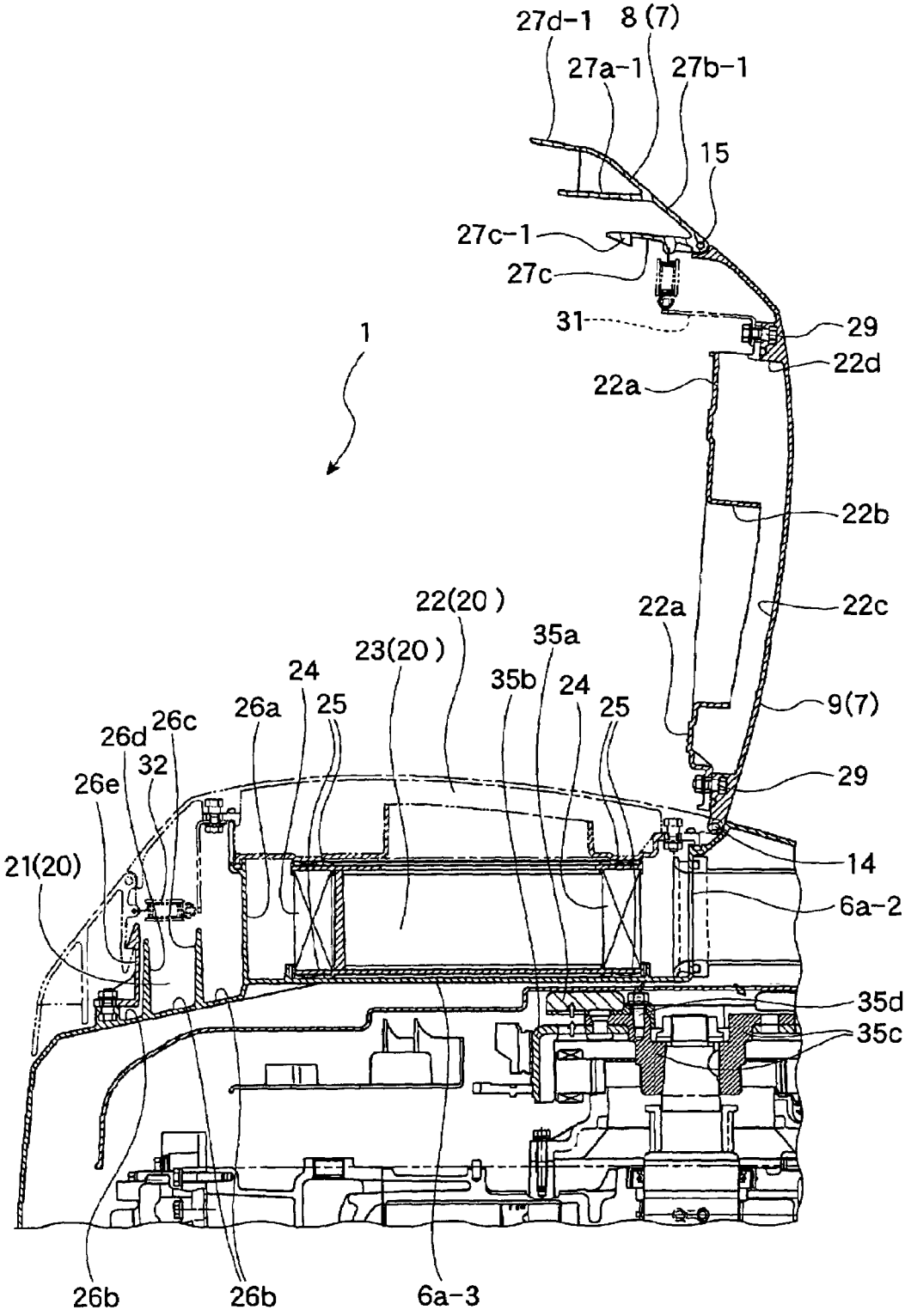
FIG. 7 is a side sectional view of the outboard motor of FIG. 1 in a state in which the open/closed knob and a cover body are open.

The open/close knob 8 can be opened by slipping a hand through the gap "C" (shown in FIG. 6) between the open/close knob 8 and the rear-side step floor surface portion 6*a*-3 of the cowling 6. This action can release the engagement between the engaging portion 27*c*-1 of the locking wall 27*c* and the engaged portion 26*e*-1 of the locked wall 26*e*. As the open/close knob 8 is opened further, the cover body 9 can also opened, as shown in FIG. 7.

In another embodiment, when the cover body 9 is closed, the open/close knob 8 can also closed. Due to the contractive force of the spring 32, the open/close knob 8 can be pulled toward the rear-side step floor surface portion 6*a*-3 of the cowling 6, and the engaging portion 27*c*-1 of the locking wall 27*c* and the engaged portion 26*e*-1 of the locked wall 26*e* can be brought into engagement with each other, thereby closing the cover member 7.

As described above, the outboard motor 1 can be configured such that the first water separating portion 21 has the intake passage 21*a* in fluid communication between the right-side intake port 9*c*-1 and the left-side intake port 9*c*-2. In such an embodiment, because the right-side intake port 9*c*-1 and the left-side intake port 9*c*-2 are in fluid communication with each other by the intake passage 21*a*, without any barrier directly between and resisting water flow between the right-side intake port and the left-side intake port, as illustrated in FIGS. 2 and 5, water that ingresses from one of the intake ports 9*c*-1, 9*c*-2 can be passed to the other of the intake ports 9*c*-1, 9*c*-2 to be drained. Therefore, it is possible to improve the drainage property of the outboard motor 1 having the intake ports 9*c*-1, 9*c*-2 formed in the two left and right side surfaces of the top cowl body 6*a*, and to prevent the ingress of water into the intake duct 13.

Further, as discussed above, the intake ports can include the right-side intake port 9*c*-1 formed in the right side surface portion of the upper portion of the top cowl body 6*a* and the left-side intake port 9*c*-2 formed in the left side surface portion of the upper portion of the top cowl body 6*a*. Accordingly, an improvement can be achieved in terms of the water-ingress preventing performance for preventing water ingress into the outboard motor 1 during no-steering back trawl due to the provision of the intake ports 9*c*-1, 9*c*-2 in the side surface portions of the upper portion of the cowling 6 as opposed to having the intake ports 9*c*-1, 9*c*-2 on the rear side of the cowling 6.

As mentioned above, in an embodiment, the intake passage 21*a* can be curved in a convex and arcuate shape toward the rear of the outboard motor 1. The intake passage 21*a* (which can be referred to as "an intake port communication passage") extends arcuately between the right-side and left-side intake ports 9*c*-1, 9*c*-2 along a longitudinal direction of the intake passage 21*a* without any barriers extending transversely to the longitudinal direction and interfering with water flow between the right-side and left-side intake ports 9*c*-1, 9*c*-2, the intake passage 21*a* extending in a convex shape relative to a rear of the outboard motor 1. Thus, even in the event of water ingress into the first water separating portion 21, a centrifugal force can be exerted on the water flowing in the intake passage 21*a* in the tangential direction of the arcuate shape, so that the water can be drawn toward the rear walls 27*a*-1, 27*a*-2 of the intake passage 21*a*. At the same time, air can be drawn toward the front wall 26*a* of the intake passage 21*a* and be passed into the second water separating portion 22 through the communication port 28. Therefore, when the air sucked in from the intake ports 9*c*-1, 9*c*-2 contains a large amount of water, the water can be effectively separated from the air to thereby mitigate the ingress of water into the engine compartment 11.

Further, in accordance with an aspect of an embodiment, the intake passage 21*a* can be formed in an arcuate shape to allow a large passage volume, as compared with the case where the intake passage 21*a* is formed linearly.

The bottom wall 26*b* of the intake passage 21*a* can be formed so as to be tapered downward from the substantially central portion of the bottom wall 26*b* at the top toward each of the intake ports 9*c*-1, 9*c*-2. Thus, even when water has ingressed from one of the intake ports 9*c*-1, 9*c*-2, the ingress of water to the substantially central portion of the intake passage 21*a* can be inhibited, or, even when the water has ingressed to the substantially central portion, the water can be readily flown to the other of the intake ports 9*c*-1, 9*c*-2 to be drained away. Accordingly, an improvement can be achieved in terms of the drainage property in the first water separating portion 21.

The communication port 28 can be formed substantially at the center of the front wall 26*a* of the intake passage 21*a*, and can be open at a position higher than the bottom wall 26*b* of the intake passage 21*a*. Therefore, when water is moved to the rear wall 27*a*-1, 27*a*-2 side of the intake passage 21*a*, air can be moved to the front wall 26*a* side of the intake passage 21*a* where water does not readily ingress. Accordingly, it is possible to inhibit the ingress of water into the second water separating portion 22.

The communication port 28 can also be formed substantially at the center of the front wall 26*a* of the intake passage 21*a*. Further, the communication port 28 can be formed at a location in the far back from the intake ports 9*c*-1, 9*c*-2 to thereby inhibit the ingress of water into the second water separating portion 22.

The front wall 26*a* of the intake passage 21*a* can be formed to project substantially at the center thereof toward the front of the outboard motor 1. Accordingly, if water ingresses into the first water separating portion 21, such water can flow straight ahead along the intake passage 21*a* while maintaining an inertial force, so that the water is not likely to abruptly flow from the intake passage 21*a* to the central wall portion 26*a*-2 that projects toward the front of the outboard motor 1.

The passage front wall-side guide wall 26*c* and the passage substantially-center guide wall 26*d* can be disposed in the intake passage 21*a* and can be configured to cause water to flow along the intake passage 21*a*. Therefore, the water that has ingressed into the first water separating portion 21 can flow in the longitudinal direction of the intake passage 21*a*, thereby making it possible to inhibit the water from flowing in the direction orthogonal to the longitudinal direction. Accordingly, it is possible to inhibit the ingress of water into the communication port 28, which communication port 28 can advantageously be formed in the direction orthogonal to the longitudinal direction of the intake passage 21*a*.

In accordance with an aspect of some embodiments, it is possible to inhibit the water that has ingressed into the second water separating portion 22 from ingressing into the third water separating portion 23. As mentioned, some embodiments can be configured such that the second water separating portion 22 can be provided and disposed in front of the first water separating portion 21, and can be in fluid communication with the first water separating portion 21. Additionally, other embodiments can be configured such that the third water separating portion 23 can be provided and disposed below the second water separating portion 22, and can be in fluid communication with the second water separating portion 22. The engine compartment 11 can be in fluid communication with the third water separating portion 23. The upwardly extending hollow annular member 22*b* can be formed in the partition wall 22*a* and can be provided between the second water separating portion 22 and the third water separating portion 23. Air in the second water separating portion 22 can be sucked into the third water separating portion 23 from the upper-end opening of the hollow annular member 22*b* and flow into the engine compartment 11. Therefore, by providing the hollow annular member 22*b* on the second water separating portion 22 side, it is possible to inhibit the passage of water in the second water separating portion 22 through the hollow annular member 22*b* while readily allowing the passage of air in the second water separating portion 22 through the hollow annular member 22*b*. Therefore, it is possible to inhibit the water that has ingressed into the second water separating portion 22 from ingressing into the third water separating portion 23.

The partition wall 22*b* can also provided so as to be tilted downward from the second water separating portion 22 toward the first water separating portion 21. Such an embodiment can tend to ensure that water that has ingressed into the second water separating portion 22 can be returned to the first water separating portion 21 and drained from the intake ports 9*c*-1, 9*c*-2 through the intake passage 21*a*.

As discussed above, the cowling 6 can include the top cowl body 6*a*, the bottom cowl body 6*b*, and the cover 7 in which the intake ports 9*c*-1, 9*c*-2 can be formed. Further, the top cowl body 6*a* can be attached to the center-side step side surface portion 6*a*-2 and rear-side step floor surface portion 6*a*-3 of the top cowl body 6*a* so as to freely open and close. Accordingly, the first water separating portion 21 and the second water separating portion 22 can be created when the cover 7 is closed. In other words, the portions corresponding to the first water separating portion 21 and the second water separating portion 22 can simply be formed on the top cowl body 6*a* side and the cover 7 side, respectively, to thereby facilitating the formation of the first separating portion 21 and second water separating portion 22 when the cover 7 is closed. Thus, with continued reference to FIG. 6, a portion of the cowl body 6*a* can form lower parts of the first and second water separating portions 21, 22 and the cover 7 can form upper parts of the first and second water separating portions 21, 22. Thus, when the cover 7 is closed, the first water separating portion 21 and the second water separating portion 22 are formed.

With the cover 7 closed, the gaps "B" and "C," which can serve to discharge ingressed water to the outside, can also be formed between the lower end of the rear wall 27*a* of the cover 7 and the rear-side step floor surface portion 6*a*-3 of the top cowl body 6*a*. Such a feature can provide an improvement in terms of the drainage property of the water that has ingressed into the first water separating portion 21.

The water-repellent filter 24, which can separate water from air, can be provided in at least one of the first water separating portion 21, the second water separating portion 22, and the third water separating portion 23. Accordingly, even when moisture such as water vapor or droplets has ingressed into the first water separating portion 21, the second water separating portion 22, or the third water separating portion 23, the moisture can be blocked by the water-repellent filter 24, thereby making it possible to prevent the ingress of water into the intake duct 13.

The filter 24 can be one of a variety of water-repellent filters that exhibits water repellency. Such a filter 24 can repel water before the water reaches the intake opening 13*a* of the intake duct 13, thereby making it possible to prevent the passage of water through the intake duct 13.

As mentioned above, the cowling 6 can include the top cowl body 6*a*, the bottom cowl body 6*b*, and the cover 7 in which the intake ports 9*c*-1, 9*c*-2 can be formed. Further, the top cowling body 6*a* can be attached to the center-side step side surface portion 6*a*-2 and rear-side step floor surface portion 6*a*-3 of the top cowl body 6*a* so as to freely open and close. According to an embodiment, when the cover 7 is open, the water-repellent filter 24 can be extracted. Further, in an embodiment, the cover 7 can be opened sufficient to allow ready inspection of the deterioration of the water-repellent filter 24 and to perform replacement thereof.

The intake pressure sensor can be arranged in proximity to the intake opening 13*a* of the intake duct 13. Further, as mentioned, certain embodiments can also include the replacement timing transmitting means for urging the boat operator to replace the water-repellent filter 24 on the basis of the output value of the intake pressure sensor. Accordingly, through operations, such as detecting the pressure loss due to the water-repellent filter 24 on the basis of the output value of the intake pressure sensor, taking the output value into the engine control unit, and lighting the lamp provided on the boat operating room side or the outboard motor 1 side when the output value exceeds a preset threshold, it is possible to urge the boat operator to replace the water-repellent filter 24. This can allow the boat operator to readily confirm whether or not the intake passage 20 has been clogged and to replace the water-repellent filter 24 for securing the output of the engine compartment 11.

In an embodiment of the outboard motor 1, one end of the intake duct 13 can be detachably attached to the center-side step side surface portion 6*a*-2 of the cowling 6, and the other end of the intake duct 13 can be detachably attached to the throttle body 12. Also, the other end of the intake duct 13 can be in fitted engagement with the elastic connecting member 33, which can be attached to the throttle body 12 and be configured to be open in a bell shape. Accordingly, any misalignment between the intake duct 13 and the throttle body 12 that may occur when bringing the intake duct 13 and the throttle body 12 into fitting engagement with each other can be absorbed by the connecting member 33 due to its configuration and material characteristics. Further, it is possible to ensure the sealing property of the final connection.

While the cover 7 can be formed separately from the cowling 6 in the first embodiment, such an embodiment is only exemplary and the inventions are not limited by such a possible embodiment. In other words, it is also possible to form the cover 7 and the cowling 6 integrally with each other, with the cover 7 constituting a part of the "upper portion" of the cowling 6.

Second Embodiment of the Inventions

A second embodiment will now be described. It should be noted that portions that are the same as those discussed above are denoted by the same reference numerals and detailed description thereof is not repeated.

Figure 8:
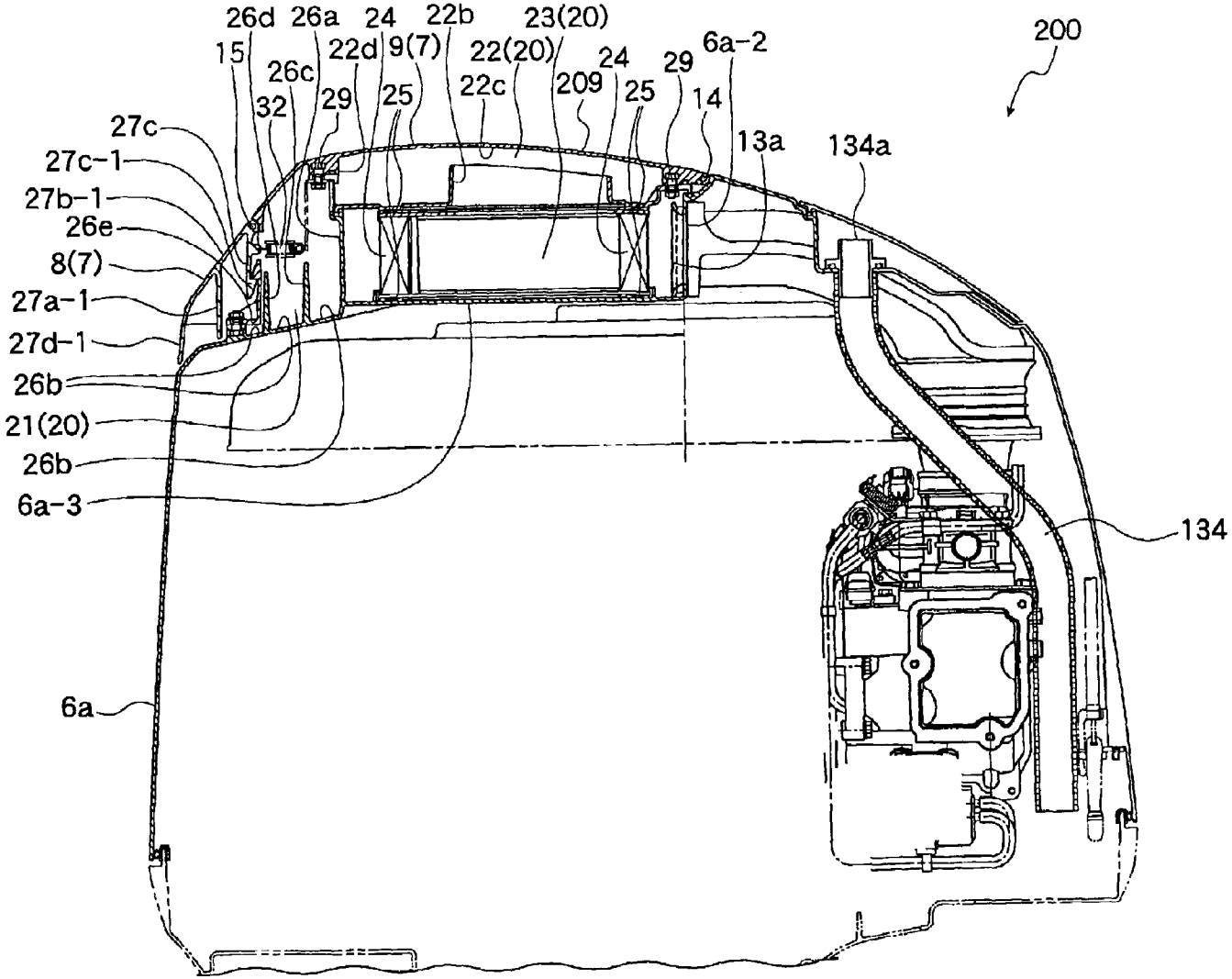
FIG. 8 is a side sectional view showing a state in which a ventilation duct is arranged on the front side of an outboard motor in accordance with a second embodiment.

FIG. 8 shows a side sectional view showing a state in which a ventilation duct 134 is arranged on the front side of an outboard motor 200 in accordance with the second embodiment. The outboard motor 200 of the second embodiment can differs from the outboard motor 1 of the first embodiment in the following respect. That is, in the case of the cover 9 of the outboard motor 1, as shown in FIGS. 5(*a*) and 5(*b*), the ventilation exhaust port 9*c*-3 provided in proximity to a ventilation outlet 34*a* of the ventilation duct 34 can preferably be formed near the right-side intake port 9*c*-1. Meanwhile, in the case of a cover 209 of the outboard motor 200, as shown in FIG. 8, the ventilation duct 134 can be provided on the front side of the cowling 6 along the vertical direction, and a ventilation outlet 134*a* can be mounted at a position spaced apart from the right-side intake port 9*c*-1.

In this way, the path for the ventilation duct 134, the ventilation outlet 134*a*, and the ventilation exhaust port 9*c*-3 can be provided at a position different from that of the path for the intake passage 20 and the intake ports 9*c*-1, 9*c*-2. This can make it possible to eliminate the possibility of the air discharged from the ventilation outlet 134*a* being sucked into the intake ports 9*c*-1, 9*c*-2 again, and also to achieve compact construction of the outboard motor 200.

The inventions are not limited to the above-mentioned embodiment; and it is also possible to arrange the ventilation duct 134 along the vertical direction of the engine compartment 11 in various configurations. Further, it is contemplated that uniform cooling of the engine compartment 11 can be achieved by providing a ventilation flow transversely crossing the accommodation space of the engine compartment 11.

Further, it is also possible to arrange the ventilation outlet 134*a* in a space separated from the intake ports 9*c*-1, 9*c*-2 through a partition wall, thereby preventing an increase in intake temperature which occurs as the ventilated air is sucked in by an intake system.

Third Embodiment of the Inventions

A third embodiment will now be described. It should be noted that portions that are the same as those of the first embodiment are denoted by the same reference numerals and detailed description thereof is not repeated.

Figure 9:
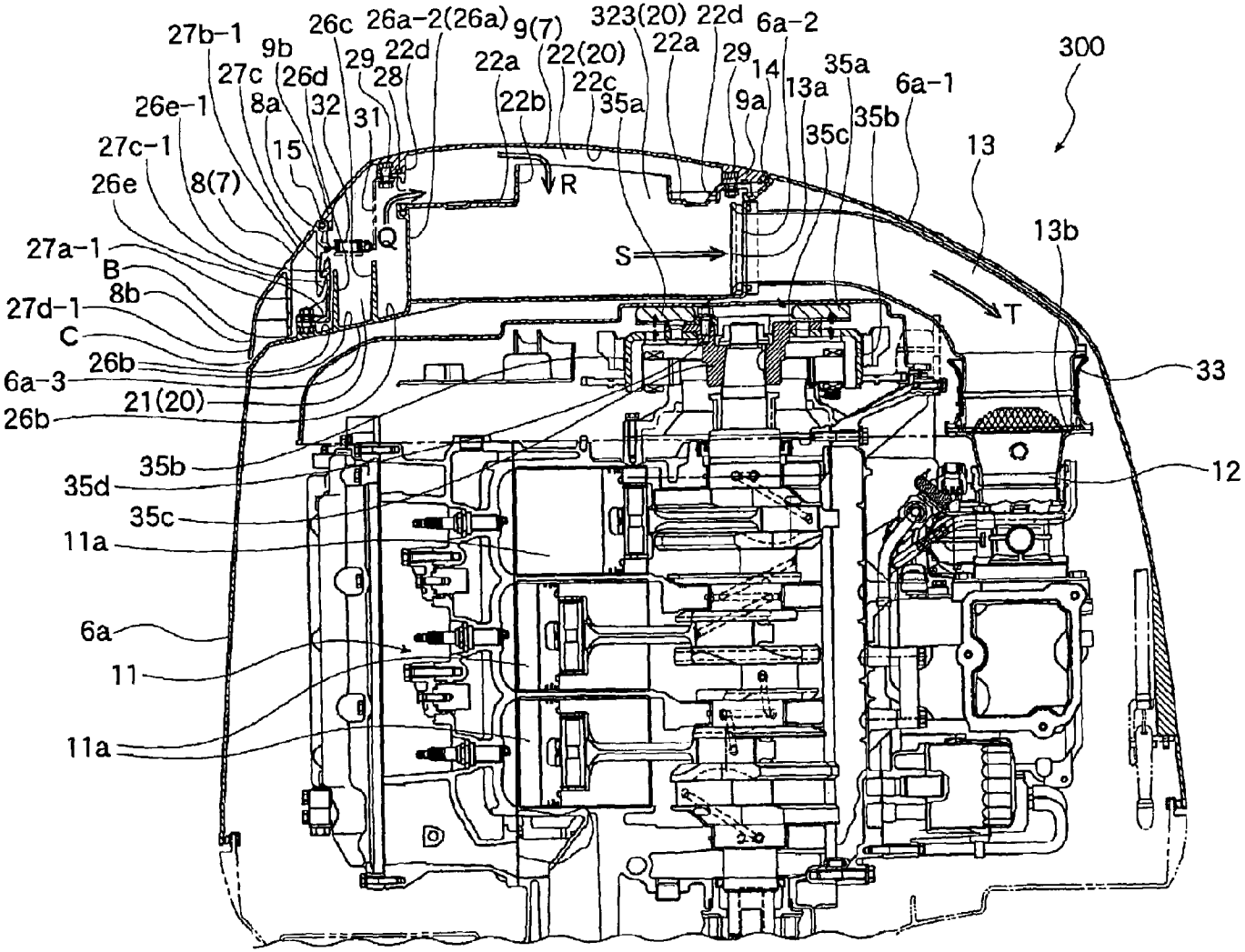
FIG. 9 is a sectional view of an outboard motor in accordance with a third embodiment.

FIG. 9 shows a sectional view of an outboard motor 300 in accordance with the third embodiment. The outboard motor 300 can differ from the outboard motor 1 of the first embodiment in that the filter 24 described with reference to the first embodiment is not required. Accordingly, air that passes through the first water separating portion 21 and the second water separating portion 22 can pass through a third passage 323 serving as "intake passage" and can then be sucked into the intake duct 13.

In this case as well, water can be removed by the first water separating portion 21 and the second water separating portion 22, thereby making it possible to inhibit the ingress of water into the intake duct 13.

Fourth Embodiment of the Inventions

A fourth embodiment will now be described. It should be noted that portions that are the same as those of the first embodiment are denoted by the same reference numerals and detailed description thereof is not repeated.

Figure 10:
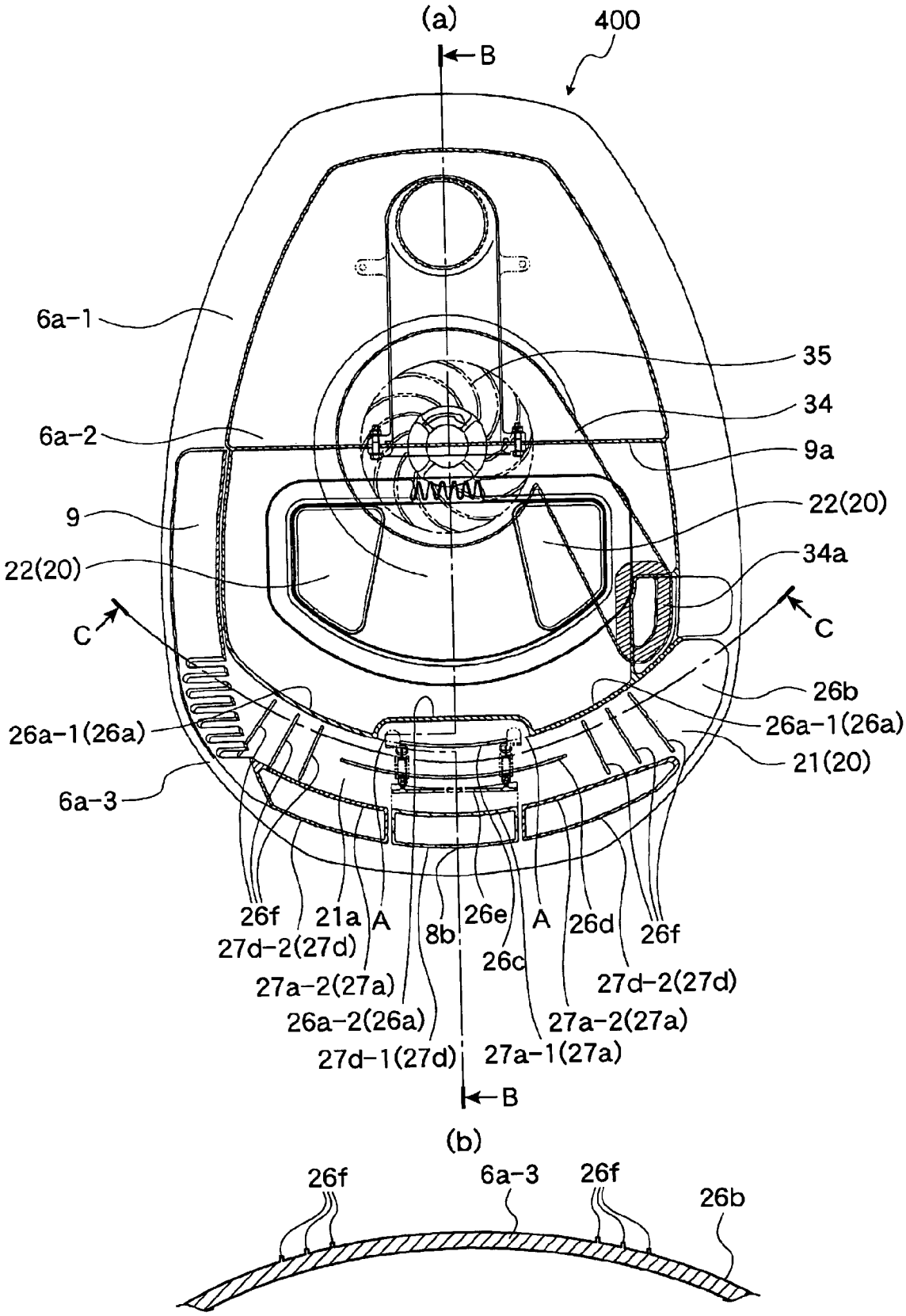
FIGS. 10(*a*) and 10(*b*) show an outboard motor in accordance with a fourth embodiment, in which FIG. 10(*a*) is a plan sectional view of the outboard motor, and FIG. 10(*b*) is a schematic end view of the outboard motor taken along the line C-C of FIG. 10(*a*).

FIGS. 10(*a*) and 10(*b*) show an outboard motor 400 in accordance with the fourth embodiment, in which FIG. 10(*a*) is a plan sectional view of the outboard motor 400, and FIG. 10(*b*) is a schematic end view of the outboard motor 400 taken along the line C-C of FIG. 10(*a*). The outboard motor 400 can differ from the outboard motor 1 of the first embodiment in that at least one linear protrusions 26*f* can be provided to suppress the strength of the ingress water can be formed on the bottom wall 26*b* of the intake passage 21*a*.

Further, a plurality of the linear protrusions 26*f* can be formed at each predetermined interval in proximity to the intake ports 9*c*-1, 9*c*-2 and in the direction orthogonal to the arcuate direction of the intake passage 21*a*.

The linear protrusions 26*f* can be provided to suppress the strength of water that has ingressed from the intake ports 9*c*-1, 9*c*-2. The linear protrusions 26*f* can be formed on the bottom wall 26*b* of the intake passage 21*a* in the direction orthogonal to the longitudinal direction of the bottom wall 26*b*. Accordingly, the linear protrusions 26*f* can tend to reduce the speed at which the water that has ingressed from one of the intake ports 9*c*-1, 9*c*-2 flows in the intake passage 21*a*.

Fifth Embodiment of the Inventions

A fifth embodiment will now be described. It should be noted that portions that are the same as those of the first embodiment are denoted by the same reference numerals and detailed description thereof is not repeated.

Figure 11:
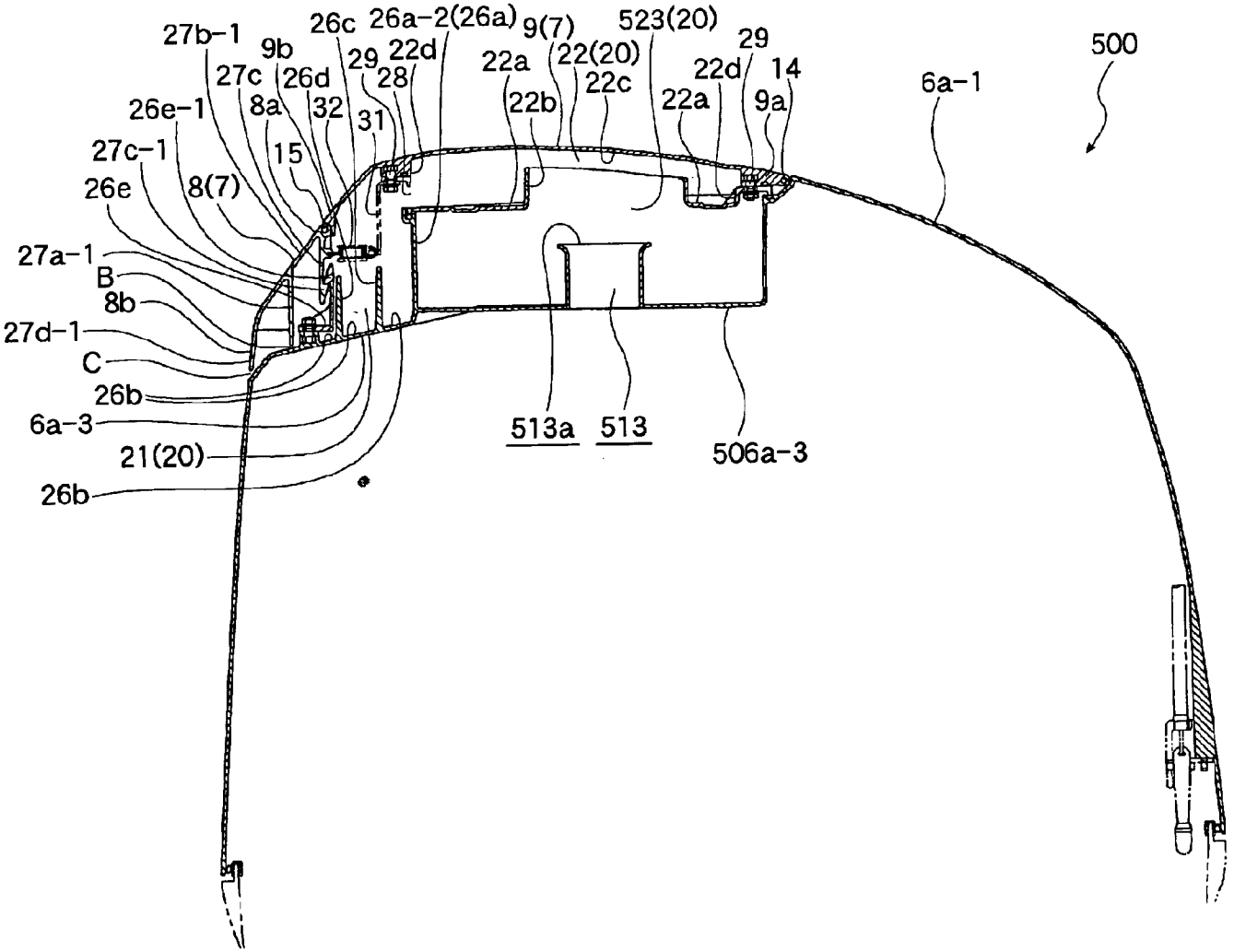
FIG. 11 is a sectional view of an outboard motor in accordance with a fifth embodiment.

FIG. 11 shows a sectional view of an outboard motor 500 in accordance with the fifth embodiment. The outboard motor 500 can differ from the outboard motor 1 of the first embodiment in that the filter 24 according to the first embodiment is not required. Further, an upper portion of an intake duct 513 can be provided so as to project upward from a bottom wall portion 506*a*-3 of a third water separating portion 523.

The upper portion of the intake duct 513 can be attached so as to project from the bottom wall portion 506*a*-3 of the third water separating portion 523, which can serve as an "intake passage," thereby communicating between the third water separating portion 523 and the intake duct 513. Accordingly, even when both water and air have ingressed into the third water separating portion 523, it is possible to prevent ingress of water from an intake opening 513*a* into the intake duct 513. For example, air containing water can flow from the second water separating portion 22 toward the third water separating portion 23, and water can accumulate on the bottom wall portion 506*a*-3 of the third water separating portion 523, thus causing the ingress of water from an intake opening 513*a* into the intake duct 513. In such a situation, the upper portion of the intake duct 513 can configured so as to project from the bottom wall portion 506*a*-3 of the third water separating portion 523 to prevent ingress of water to the intake opening 513*a*.

In another aspect of certain embodiments, the other end 13*b* of the intake duct 13 can be attached to the throttle body 12, for example, in the first to fourth embodiments, although the inventions are not so limited. In other words, it is also possible to adopt a construction in which the other end 13*b* of the intake duct 13 can be attached to an intake system. For example, it is possible to adopt a construction in which the other end 13*b* of the intake duct 13 can be attached to an air cleaner as "intake system" or to an intake chamber or silencer as "intake system."

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An outboard motor comprising:

a cowling having an upper portion and at least partially defining an engine compartment;

a right-side intake port formed in a right side surface portion of the upper portion of the cowling;

a left-side intake port formed in a left side surface portion of the upper portion of the cowling; and a water separating portion being in fluid communication with the right-side and left-side intake ports, the water separating portion and the engine compartment being in fluid communication with each other by an intake duct, wherein the water separating portion includes first and second water separating portions, the first water separating portion having an intake port communication passage that communicates between the right-side intake port and the left-side intake port without any barrier directly between and resisting water flow between the right-side intake port and the left-side intake port, the intake port communication passage being defined by a front wall, a rear wall, a bottom wall and a ceiling and extending between the right-side intake port and the left-side intake port, the second water separating portion being in fluid communication with the first water separating portion via a communication port, the second water separating portion being in fluid communication with the engine compartment for discharging water therefrom.

2. An outboard motor comprising:

a cowling having an upper portion and at least partially defining an engine compartment;

a right-side intake port formed in a right side surface portion of the upper portion of the cowling;

a left-side intake port formed in a left side surface portion of the upper portion of the cowling; and a water separating portion being in fluid communication with the right-side and left-side intake ports, the water separating portion and the engine compartment being in fluid communication with each other by an intake duct, wherein the water separating portion includes first and second water separating portions, the first water separating portion having an intake port communication passage that communicates between the right-side intake port and the left-side intake port without an barrier, the second water separating portion being in fluid communication with the first water separating portion via a communication port, the second water separating portion being in fluid communication with the engine compartment for discharging water therefrom, wherein the intake port communication passage is an arcuate intake passage that is curved in a convex and arcuate shape toward a rear of the outboard motor.

3. The outboard motor according to claim 1, wherein a bottom wall of the intake port communication passage is formed so as to be tapered downward from a substantially central portion of the bottom wall at a top toward each of the right-side and left-side intake ports.

4. The outboard motor of claim 1 wherein the communication port is formed substantially at the center of a front wall of the intake port communication passage, and is open at a position higher than the bottom wall of the intake port communication passage.

5. The outboard motor of claim 1 wherein the front wall of the intake port communication passage projects substantially at the center thereof toward the front of the outboard motor.

6. The outboard motor of claim 1 wherein the intake port communication passage has a guide wall provided therein for causing water to flow along the intake port communication passage.

7. The outboard motor of claim 1 wherein the second water separating portion communicating with the first water separating portion is provided in front of the first water separating portion, and the outboard motor further comprises a third water separating portion and an upwardly projecting hollow annular member, the third water separating portion communicating with the second water separating portion is provided below the second water separating portion, the engine compartment being in communication with the third water separating portion, the upwardly projecting hollow annular member being formed in a partition wall provided between the second water separating portion and the third water separating portion, wherein air in the second water separating portion can be sucked into the third water separating portion from an upper-end opening of the hollow annular member.

8. The outboard motor of claim 7 wherein the partition wall is provided so as to be tilted downward from the second water separating portion toward the first water separating portion.

9. The outboard motor of claim 7 wherein an upper portion of the intake duct is attached to a bottom wall portion of the third water separating portion so as to project from the bottom wall portion, for communicating between the third water separating portion and the intake duct.

10. An outboard motor comprising a cowling having an upper portion and at least partially defining an engine compartment;

a right-side intake port formed in a right side surface portion of the upper portion of the cowling;

a left-side intake port formed in a left side surface portion of the upper portion of the cowling; and a water separating portion being in fluid communication with the right-side and left-side intake ports, the water separating portion and the engine compartment being in fluid communication with each other by an intake duct, wherein the water separating portion includes first and second water separating portions, the first water separating portion having an intake port communication passage that communicates between the right-side intake port and the left-side intake port, the second water separating portion being in fluid communication with the first water separating portion via a communication port, the second water separating portion being in fluid communication with the engine compartment for discharging water therefrom;

wherein the cowling further comprises a cowling body forming lower parts of the first and second water separating portions and a cover forming upper parts the first and second water separating portions, the intake port being formed in the cover, the cover being attached to an upper portion of the cowling body with an engaging portion and a moveable knob configured to release the engaging portion so that the cover can freely open and close, wherein when the cover is closed, the first water separating portion and the second water separating portion are formed.

11. The outboard motor of claim 10 wherein with the cover closed, a gap for discharging ingress water to the outside is formed between the cover and the cowling body.

12. The outboard motor of claim 1 further comprising a third water separating portion and a filter, the third water separating portion being in communication with the second water separating portion is provided below the second water separating portion, the third water separating portion communicating with the engine compartment, the filter being operative to separate water and air from each other and being provided in one of the first water separating portion, the second water separating portion, and the third water separating portion.

13. The outboard motor of claim 12 wherein the filter has water repellency.

14. An outboard motor comprising:

a cowling having an upper portion and at least partially defining an engine compartment;

a right-side intake port formed in a right side surface portion of the upper portion of the cowling;

a left-side intake ort formed in a left side surface portion of the upper portion of the cowling; and a water separating portion being in fluid communication with the right-side and left-side intake ports, the water separating portion and the engine compartment being in fluid communication with each other by an intake duct, wherein the water separating portion includes first and second water separating portions, the first water separating portion having an intake port communication passage that communicates between the right-side intake port and the left-side intake port without any barrier, the second water separating portion being in fluid communication with the first water separating portion via a communication port the second water separating portion being in fluid communication with the engine compartment for discharging water therefronm;

a third water separating portion and a filter, the third water separating portion being in communication with the second water separating portion is provided below the second water separating portion, the third water separating portion communicating with the engine compartment, the filter being operative to separate water and air from each other and being provided in one of the first water separating portion, the second water separating portion, and the third water separating portion; and an intake pressure sensor and a replacement timing transmitting means, the intake pressure sensor being arranged in proximity to the intake opening in the intake duct, the replacement timing transmitting means being operative to urge a boat operator to replace the filter on the basis of an output value of the intake pressure sensor.

15. An outboard motor comprising:

a cowling having an upper portion and at least partially defining an engine compartment;

a right-side intake port formed in a right side surface portion of the upper portion of the cowling;

a left-side intake port formed in a left side surface portion of the upper portion of the cowling; and a water separating portion being in fluid communication with the right-side and left-side intake ports, the water separating portion and the engine compartment being in fluid communication with each other by an intake duct, wherein the water separating portion includes first and second water separating portions, the first water separating portion having an intake port communication passage that communicates between the right-side intake port and the left-side intake port, the second water separating portion being in fluid communication with the first water separating portion via a communication port, the second water separating portion being in fluid communication with the engine compartment for discharging water therefrom;

wherein one end of the intake duct is detachably attached to the upper portion of the cowling, the other end of the intake duct is detachably attached to a throttle portion, and the other end of the intake duct is brought into fitting engagement with a connecting member that is attached to the throttle body and is open in a bell shape.

16. The outboard motor of claim 1 wherein a linear protrusion for suppressing strength of ingress water is formed on the bottom wall of the intake port communication passage in a direction orthogonal to a longitudinal direction of the bottom wall.

17. An outboard motor comprising:

a cowling having an upper portion and at least partially defining an engine compartment;

a right-side intake port formed in a right side surface portion of the upper portion of the cowling;

a left-side intake port formed in a left side surface portion of the upper portion of the cowling; and a water separating portion being in fluid communication with the right-side and left-side intake ports, the water separating portion and the engine compartment being in fluid communication with each other by an intake duct, wherein the water separating portion includes first and second water separating portions separated from each other by a transversely extending wall, the first water separating portion having an intake port communication passage that communicates between the right-side intake port and the left-side intake port, the intake port communication passage extending arcuately between the right-side and left-side intake ports along a longitudinal direction without an barriers extending transversel to the longitudinal direction and interfering with water flow between the right-side and left-side intake ports, the intake port communication passage extending in a convex shape relative a rear of the outboard motor, the second water separating portion being in fluid communication with the first water separating portion via a communication port in the transversely extending wall, the second water separating portion being in fluid communication with the engine compartment for discharging water therefrom.

18. The outboard motor of claim 1 additionally comprising a guide wall extending into the intake port communication passage and extending along a longitudinal direction of the intake port communication passage so as to cause water to flow along the longitudinal direction of the intake port communication passage.

19. The outboard motor of claim 18, wherein the guide wall is disposed adjacent to the communication port.

20. The outboard motor of claim 19, where the guide wall is positioned to inhibit water from flowing in a direction orthogonal to the longitudinal direction of the intake port communication passage.

21. The outboard motor of claim 20 where the guide wall is configured to inhibit water from flowing from the intake port communication passage into the second water separating portion, through the communication port.

22. The outboard motor of claim 2, wherein the intake port communication passage is configured to allow water entering the left-side intake port to flow directly through the intake port communication passage and out of the right-side intake port.

* * * * *

UNITED STATES PATENT AND TRADEMARK OFFICE

CERTIFICATE OF CORRECTION

PATENT NO. : 7,524,223 B2
APPLICATION NO. : 11/586784
DATED : April 28, 2009
INVENTOR(S) : Ochiai et al.

It is certified that error appears in the above-identified patent and that said Letters Patent is hereby corrected as shown below:

In column 16, line 29, change “an” to --any--.

In column 17, line 11, after “comprising” insert --:--.

In column 17, line 34, after “parts” insert --of--.

In column 17, line 63, change “ort” to --port--.

In column 18, line 9, change “port” to --port,--.

In column 18, line 11, change “therefronm” to --therefrom;--.

In column 19, line 12, change “an” to --any--.

In column 19, line 12, change “transversel” to --transversely--.

In column 19, line 16, after “relative” insert --to--.

Signed and Sealed this

Twenty-seventh Day of April, 2010

David J. Kappos

David J. Kappos
*Director of the United States Patent and Trademark Office*